US012546473B2

(12) United States Patent
Walters

(10) Patent No.: US 12,546,473 B2
(45) Date of Patent: Feb. 10, 2026

(54) COMBUSTOR ASSEMBLY FOR A GAS TURBINE ENGINE

(71) Applicant: ROLLS-ROYCE plc, London (GB)

(72) Inventor: Edward A. Walters, Derby (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 19/061,269

(22) Filed: Feb. 24, 2025

(65) Prior Publication Data

US 2025/0230931 A1 Jul. 17, 2025

Related U.S. Application Data

(62) Division of application No. 18/669,683, filed on May 21, 2024.

(30) Foreign Application Priority Data

Jun. 6, 2023 (GB) ..... 2308411

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00017* (2013.01)

(58) Field of Classification Search
CPC ... F23R 3/002; F23R 2900/00017; F23R 3/60
See application file for complete search history.

(56) References Cited

U.S. PATENT DOCUMENTS 5,419,115 A 5/1995 Butler et al.
2003/0145604 A1 8/2003 Pidcock et al.
2004/0035115 A1* 2/2004 Farmer ..... F23R 3/50 60/752

(Continued)

FOREIGN PATENT DOCUMENTS

EP 1058061 A1 12/2000

OTHER PUBLICATIONS

Great Britain search report dated Dec. 4, 2023, issued in GB Patent Application No. 2308411.4.

(Continued)

*Primary Examiner* — Thomas P Burke

(57) ABSTRACT

A combustor assembly for a gas turbine engine includes a combustor shell extending along a shell axis. The combustor shell includes a shell wall extending around the shell axis and a meter panel connected to an upstream end of the shell wall. The shell wall and the meter panel together define a combustion space therebetween. The combustor assembly further includes: a tile disposed within the combustor shell and including a tile flange portion extending radially with respect to the shell axis; a heatshield connected to the meter panel and extending at least radially towards the tile; a fastener connecting the tile flange portion to the meter panel; and a compartment thermally shielded from the combustion space. Either the heatshield and the tile together form the compartment or the tile alone forms the compartment. The fastener is spaced apart from the combustion space and at least partially disposed within the compartment.

13 Claims, 5 Drawing Sheets

(56) References Cited

U.S. PATENT DOCUMENTS

| | | | | |
|---|---|---|---|---|
| 2004/0250548 | A1* | 12/2004 | Howell | F23R 3/60 60/804 |
| 2011/0030378 | A1 | 2/2011 | Carlisle | |
| 2014/0360196 | A1* | 12/2014 | Graves | F23R 3/002 60/753 |
| 2017/0003026 | A1 | 1/2017 | Holdcraft et al. | |
| 2017/0059167 | A1 | 3/2017 | Bloom et al. | |
| 2017/0248315 | A1* | 8/2017 | Hannwacker | F02C 7/20 |
| 2017/0276356 | A1 | 9/2017 | Mulcaire et al. | |
| 2019/0137101 | A1 | 5/2019 | Bloom et al. | |
| 2020/0191397 | A1 | 6/2020 | Tentorio et al. | |
| 2020/0284199 | A1 | 9/2020 | Morenko | |
| 2021/0102705 | A1* | 4/2021 | Kramer | F23R 3/60 |
| 2021/0325043 | A1 | 10/2021 | Freeman et al. | |
| 2023/0296251 | A1 | 9/2023 | Sampath et al. | |

OTHER PUBLICATIONS

European search report dated Aug. 29, 2024, issued in EP Patent Application No. 24174518.1.

* cited by examiner

COMBUSTOR ASSEMBLY FOR A GAS TURBINE ENGINE

CROSS-REFERENCE TO RELATED APPLICATIONS

This application is a divisional application of U.S. application Ser. No. 18/669,683 filed on May 21, 2024, which is based upon and claims the benefit of priority from United Kingdom patent application GB 2308411.4 filed on Jun. 6, 2023. The entire contents of each of these applications are incorporated herein by reference in their entirety.

BACKGROUND

Technical Field

The present disclosure relates to a combustor assembly for a gas turbine engine.

Description of the Related Art

Gas turbine engines may be used to power aircraft, watercraft, power generators, and the like. A gas turbine engine typically includes, in axial flow series, a compressor, a combustor, and a turbine. The compressor compresses air drawn into the gas turbine engine and delivers high pressure air to the combustor. In the combustor, fuel is mixed with the high pressure air, and the mixture is combusted.

The combustor typically includes a combustor shell and a plurality of tiles connected to the combustor shell to thermally shield the combustor shell from high combustion temperatures arising due to the combustion. Conventionally, each of the plurality of tiles is connected to a circumferential shell wall of the combustor shell by fasteners, such as threaded studs. However, such fasteners may be prone to failure.

Therefore, there is a need for a combustor assembly that can improve retention of the plurality of tiles to the combustor shell.

SUMMARY

According to a first aspect there is provided a combustor assembly for a gas turbine engine. The combustor assembly includes a combustor shell extending along a shell axis. The combustor shell includes a shell wall extending circumferentially around the shell axis. The shell wall includes an upstream end and a downstream end opposite to the upstream end. The combustor shell further includes a meter panel connected to the upstream end of the shell wall. The meter panel extends radially with respect to the shell axis. The meter panel and the shell wall together define a combustion space therebetween. The combustor assembly further includes a tile disposed within and adjacent to the combustor shell. The tile includes a tile flange portion disposed at an upstream end of the tile. The tile flange portion extends radially with respect to the shell axis. The tile flange portion is disposed adjacent to the meter panel. The combustor assembly further includes a heatshield connected to the meter panel radially inwards of the combustor shell. The heatshield extends at least radially towards the tile. The combustor assembly further includes a fastener connecting the tile flange portion of the tile to the meter panel of the combustor shell. The fastener extends along the shell axis. The combustor assembly further includes a compartment thermally shielded from the combustion space.

Either the heatshield and the tile together form the compartment or the tile alone forms the compartment. The fastener is spaced apart from the combustion space. The fastener is at least partially disposed within the compartment.

The compartment of the combustor assembly may thermally shield and protect the fastener from high combustion temperatures of the combustion space. Specifically, the heatshield and/or the tile forming the compartment may thermally shield and protect the fastener from the high combustion temperatures. Consequently, the fastener may have a prolonged operational lifespan and may perform reliably over its operational lifespan. As a result, the fastener may reliably connect the tile flange portion of the tile to the meter panel of the combustor shell.

The combustor assembly may therefore have a reliable connection between the tile and the combustor shell, and as a result may have an improved mechanical integrity. Furthermore, the combustor assembly may have reduced manufacturing lead times, reduced maintenance costs, and may be easier to maintain as compared to a conventionally fabricated combustor liner.

The combustor assembly may have an array of tiles, e.g. a circular array of tiles, and/or the combustor assembly may have an array of heatshields, e.g. a circular array of heatshields.

In some embodiments, the tile further includes an upstream part including the tile flange portion. The tile further includes a downstream part spaced apart from the upstream part. The downstream part at least partially engages the shell wall of the combustor shell. The tile further includes a main part connecting the upstream part to the downstream part. The main part is radially spaced apart from the shell wall with respect to the shell axis.

The upstream part of the tile may be connected to the meter panel, and the downstream part of the tile may be retained in a floating relationship relative to the shell wall. Advantageously, this design of the tile may allow the shell wall and/or the tile to thermally expand axially along the shell axis while the downstream part of the tile is retained in the floating relationship relative to the shell wall.

In some embodiments, the upstream part further includes an intermediate portion connected to the tile flange portion. The intermediate portion extends axially along the shell axis. The upstream part further includes an oblique portion extending from the intermediate portion and obliquely inclined to the shell axis. The oblique portion is connected to the main part.

The intermediate portion and the oblique portion of the tile may allow the fastener to be at least partially disposed within the compartment. Furthermore, the oblique portion may allow the main part of the tile to be radially spaced apart from the shell wall with respect to the shell axis.

In some embodiments, the intermediate portion is disposed radially outwards of the main part with respect to the shell axis. The intermediate portion at least partially engages the shell wall. The tile flange portion extends radially inwards from the intermediate portion with respect to the shell axis, such that the heatshield and the tile together form the compartment.

In some embodiments, the heatshield includes a main body that is connected to the meter panel. The heatshield further includes an arm that extends obliquely with respect to the shell axis from the main body towards the tile. The arm has a free end opposite to the main body and disposed adjacent to the tile. The main part of the tile includes a compartment portion that is axially disposed between the intermediate portion of the tile and the free end of the arm with respect to the shell axis. The arm of the heatshield, the upstream part of the tile, and the compartment portion of the main part together form the compartment.

In some embodiments, the fastener is at least partially disposed between the intermediate portion of the tile and the heatshield.

In some embodiments, the meter panel further delimits the compartment.

In the aforementioned configuration of the heatshield and the tile, the heatshield and the tile may together form the compartment. Specifically, the meter panel, the heatshield, and the tile may form the compartment. The heatshield and the tile may together thermally shield the fastener from the high combustion temperatures of the combustion space.

In some embodiments, the intermediate portion of the tile is disposed radially inwards of the main part with respect to the shell axis and radially spaced apart from the shell wall of the combustor shell. The tile flange portion extends radially outwards from the intermediate portion with respect to the shell axis, such that the tile forms the compartment.

In some embodiments, the fastener is at least partially disposed between the intermediate portion of the tile and the shell wall of the combustor shell.

In some embodiments, the shell wall further delimits the compartment.

In the aforementioned configuration of the tile, the tile may form the compartment. Specifically, the tile and the shell wall may form the compartment. The tile may thermally shield the fastener from the high combustion temperatures of the combustion space.

In some embodiments, the combustor assembly further includes a bracket that is connected to the downstream end of the shell wall of the combustor shell. The bracket includes a hook extending towards the tile along the shell axis. The hook at least partially engages and supports the downstream part of the tile, such that the downstream part is at least partially disposed between the shell wall and the hook.

The bracket may retain the downstream part of the tile in a floating relationship relative to the shell wall. Advantageously, the bracket may allow the shell wall and/or the tile to thermally expand axially along the shell axis while retaining the downstream part of the tile in the floating relationship relative to the shell wall.

In some embodiments, the shell wall further includes a shell flange portion that extends radially inwards with respect to the shell axis. The shell flange portion is at least partially disposed between the meter panel and the tile flange portion. The fastener further connects the shell flange portion to the meter panel, such that the fastener connects the meter panel, the tile, and the shell wall to each other.

Advantageously, the shell flange portion of the shell wall may allow the meter panel, the tile, and the shell wall to be connected to each other by the fastener without the need of additional connection steps (such as welding). This may reduce manufacturing and assembly times of the combustor assembly.

In some embodiments, the fastener includes a nut disposed adjacent to the tile flange portion opposite to the shell flange portion. The fastener further includes a bolt that is threadably connected to the nut. The bolt includes a head disposed adjacent to the meter panel opposite to the compartment. The bolt further includes a shaft connected to the head and extending towards the compartment. The shaft extends at least partially through each of the tile flange portion, the shell flange portion, and the 10 meter panel. The shaft includes an exposed portion that is threadably connected to the nut and extends axially from the tile flange portion along the shell axis. The nut and the exposed portion of the shaft are fully disposed within the compartment.

In some embodiments, the nut is connected to the tile flange portion.

Advantageously, the nut being connected to the tile flange portion may allow the bolt to be threadably fastened to the nut without needing access to the nut and/or the compartment. This may facilitate assembly and manufacturing of the combustor assembly.

In some embodiments, the combustor assembly further includes an aerodynamic dome that is disposed upstream of the meter panel. The fastener further connects the aerodynamic dome to the meter panel.

In some embodiments, the meter panel includes a plurality of panel apertures that are in fluid communication with the heatshield. The plurality of panel apertures may allow the heatshield to be cooled by providing air to the heatshield through the plurality of panel apertures.

In some embodiments, the shell wall of the combustor shell further includes a plurality of wall apertures that are in fluid communication with the tile. The plurality of wall apertures may allow the tile to be cooled by providing air to the tile through the plurality of wall apertures.

The aerodynamic dome may assist in directing air (e.g., from a high pressure compressor) to the plurality of wall apertures of the shell wall. The aerodynamic dome may therefore improve cooling of the tile.

According to a second aspect there is provided a combustor for a gas turbine engine. The combustor includes the combustor assembly of the first aspect.

According to a third aspect there is provided a gas turbine engine. The gas turbine engine includes the combustor assembly of the first aspect.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed). The gearbox may be a reduction gearbox (in that the output to the fan is a lower rotational rate than the input from the core shaft). Any type of gearbox may be used.

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. The bypass duct may be substantially annular. The bypass duct may be radially outside the engine core. The radially outer surface of the bypass duct may be defined by a nacelle and/or a fan case.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range bounded by any two of the values in the previous sentence (i.e., the values may form upper or lower bounds), for example in the range of from 80 $Nkg^{-1}s$ to 100 $Nkg^{-1}s$, or 85 $Nkg^{-1}s$ to 95 $Nkg^{-1}s$. Such engines may be particularly efficient in comparison with conventional gas turbine engines.

A fan blade and/or aerofoil portion of a fan blade described and/or claimed herein may be manufactured from any suitable material or combination of materials. For example, at least a part of the fan blade and/or aerofoil may be manufactured at least in part from a composite, for example a metal matrix composite and/or an organic matrix composite, such as carbon fibre.

The fan of a gas turbine as described and/or claimed herein may have any desired number of fan blades, for example 14, 16, 18, 20, 22, 24 or 26 fan blades.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

Figure 1:
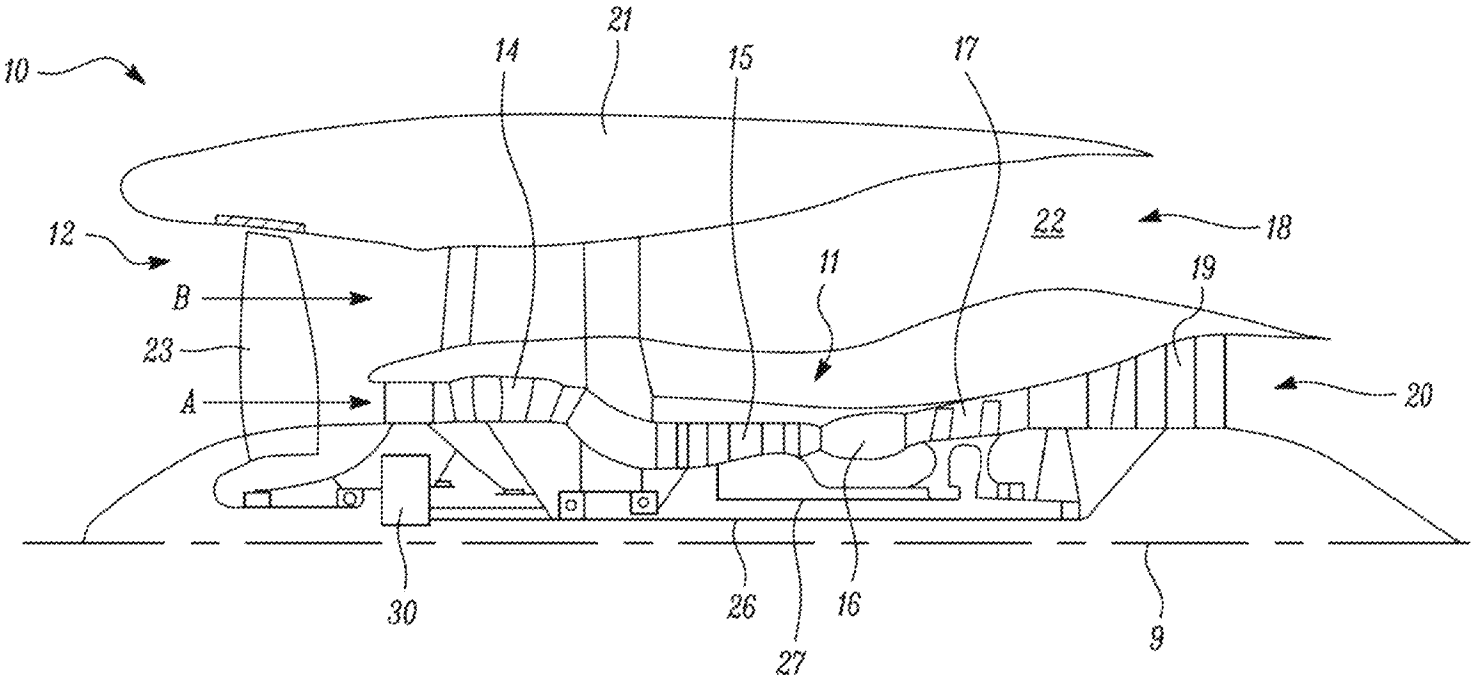
FIG. 1 is a sectional side view of a gas turbine engine.

The following table lists the reference numerals used in the drawings:

| Ref no. | Feature |
|---|---|
| 9 | Principal rotational Axis |
| 10 | Gas turbine engine |
| 11 | Engine core |
| 12 | Air intake |
| 14 | Low pressure compressor |
| 15 | High pressure compressor |
| 16 | Combustion equipment |
| 17 | High pressure turbine |
| 18 | Bypass exhaust nozzle |
| 19 | Low pressure turbine |
| 20 | Core exhaust nozzle |
| 21 | Nacelle |
| 22 | Bypass duct |
| 23 | Propulsive fan |
| 26 | Shaft |
| 27 | Interconnecting shaft |
| 30 | Epicyclic gearbox |
| 50 | Combustor |
| 60 | Fuel injector |
| 100 | Combustor assembly |
| 110 | Combustor shell |
| 111 | Shell axis |
| 112 | Shell wall |
| 113 | Upstream end of shell wall |
| 114 | Downstream end of shell wall |
| 116 | Meter panel |
| 117 | Shell flange portion |
| 119 | Injector aperture |
| 120 | Tile |
| 121 | Upstream end of tile |
| 122 | Downstream end of tile |
| 125 | Tile flange portion |
| 128 | Panel apertures |
| 129 | Wall apertures |
| 130 | Upstream part of tile |
| 132 | Downstream part of tile |
| 134 | Main part of tile |
| 136 | Intermediate portion of tile |
| 138 | Oblique portion of tile |
| 140 | Heatshield |
| 141 | Main body |
| 142 | Arm |
| 144 | Free end of arm |
| 150 | Fastener |
| 151 | Nut |
| 152 | Bolt |
| 153 | Head |
| 154 | Shaft |
| 155 | Exposed portion of shaft |
| 156 | Fastener |
| 160 | Compartment |
| 162 | Compartment portion |
| 165 | Combustion space |
| 170 | Bracket |
| 171 | Hook |
| 180 | Aerodynamic dome |
| 200 | Combustor assembly |
| 300 | Combustor assembly |
| 400 | Combustor assembly |
| $\alpha$ | Panel aperture angle |

-continued

| Ref no. | Feature |
|---|---|
| β | Wall aperture angle |
| A | Core airflow |
| B | Bypass airflow |

DETAILED DESCRIPTION

Aspects and embodiments of the present disclosure will now be discussed with reference to the accompanying figures. Further aspects and embodiments will be apparent to those skilled in the art.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high pressure compressor 15, combustion equipment 16, a high pressure turbine 17, a low pressure turbine 19, and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the core exhaust nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Note that the terms "low pressure turbine" and "low pressure compressor" as used herein may be taken to mean the lowest pressure turbine stages and lowest pressure compressor stages (i.e., not including the fan 23) respectively and/or the turbine and compressor stages that are connected together by the interconnecting shaft 26 with the lowest rotational speed in the engine (i.e., not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Other gas turbine engines to which the present disclosure may be applied may have alternative configurations. For example, such engines may have an alternative number of compressors and/or turbines and/or an alternative number of interconnecting shafts. By way of further example, the gas turbine engine 10 shown in FIG. 1 has a split flow nozzle 18, 20 meaning that the flow through the bypass duct 22 has its own nozzle 18 that is separate to and radially outside the core exhaust nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial, and circumferential directions are mutually perpendicular. As used herein, the terms "upstream" and "downstream" are considered with respect to the general direction of gas flow through the gas turbine engine 10 (that is, from left to right as viewed in FIG. 1).

Figure 2:
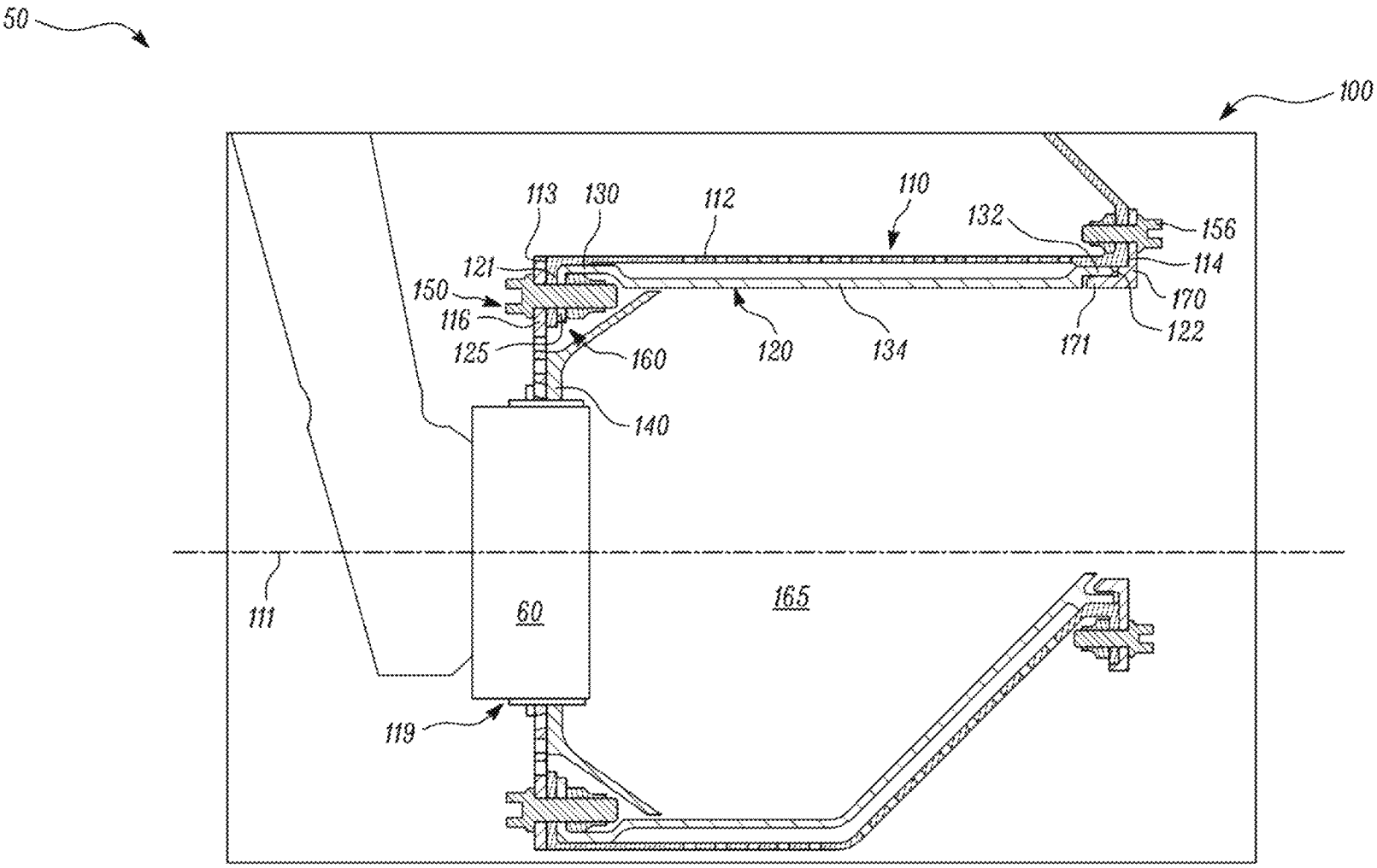
FIG. 2 is a schematic cross-sectional view of a portion of a combustor including a combustor assembly.

FIG. 2 shows a schematic cross-sectional view of a portion of a combustor 50 in accordance with an embodiment of the present disclosure. The combustion equipment 16 (shown in FIG. 1) of the gas turbine engine 10 may include the combustor 50. The combustion equipment 16 may include a plurality of combustors 50.

The combustor 50 includes a combustor assembly 100 in accordance with an embodiment of the present disclosure. The combustor assembly 100 includes a combustor shell 110 extending along a shell axis 111. The shell axis 111 may be used to define an overall geometry of the combustor assembly 100.

It may be noted that components of the combustor assembly 100 may be described herein in singular form for clarity purposes. However, it should be understood that the combustor assembly 100 may include a plurality of each of the components described herein. For example, if the combustor assembly 100 includes a component A, it should be understood that the combustor assembly 100 may include a plurality of components A.

The combustor shell 110 includes a shell wall 112 extending circumferentially around the shell axis 111. The shell wall 112 includes an upstream end 113 and a downstream end 114 opposite to the upstream end 113.

The combustor shell 110 further includes a meter panel 116 connected to the upstream end 113 of the shell wall 112. The meter panel 116 extends radially with respect to the shell axis 111. The meter panel 116 and the shell wall 112 together define a combustion space 165 therebetween.

The combustor shell 110, or more specifically, the shell wall 112 and the meter panel 116 may be made from any suitable material, such as a metal or metal alloy. For example, the combustor shell 110 may be made from a metal alloy including at least one of nickel, cobalt, and chromium.

The combustor 50 may further include a fuel injector 60 (also referred to as "fuel nozzle" and "burner"). The meter panel 116 may include an injector aperture 119 that is in fluid communication with the combustion space 165. The injector aperture 119 may extend through a thickness of the meter panel 116. Further, the injector aperture 119 may extend radially with respect to the shell axis 111. The injector aperture 119 may be configured to receive the fuel injector 60 at least partially therethrough.

The fuel injector 60 may provide fuel to the combustion space 165 that may be mixed with the compressed air exhausted from the high pressure compressor 15 (shown in FIG. 1). The mixture of fuel and the compressed air from the high pressure compressor 15 may be combusted in the combustion space 165. The combustion of the mixture may subject the combustion space 165 to high combustion temperatures that can exceed, for example, 3500 degrees F. (i.e., 2200 kelvin). Therefore, it may be desirable to protect the combustor shell 110 from the high combustion temperatures.

The combustor assembly 100 further includes a tile 120 disposed within and adjacent to the combustor shell 110. The tile 120 includes an upstream end 121 and a downstream end 122 opposite to the upstream end 121. The tile 120 further includes a tile flange portion 125 disposed at the upstream end 121 of the tile 120. The tile flange portion 125 extends radially with respect to the shell axis 111. The tile flange portion 125 is disposed adjacent to the meter panel 116. As will be described herein, the tile flange portion 125 may be used to connect the tile 120 to at least the meter panel 116 of the combustor shell 110.

The combustor assembly 100 further includes a heatshield 140 connected to the meter panel 116 radially inwards of the combustor shell 110. The heatshield 140 extends at least radially towards the tile 120. The heatshield 140 may further extend axially along the shell axis 111.

The tile 120 and the heatshield 140 may thermally shield the combustor shell 110 from the high combustion temperatures arising due to combustion of the fuel and air mixture in the combustion space 165. Specifically, the tile 120 may at least thermally shield the shell wall 112 and the heatshield 140 may at least thermally shield the meter panel 116 from the high combustion temperatures.

The tile 120 and the heatshield 140 may be made from materials suitable to withstand high temperatures including, but not limited to, composite materials (e.g., ceramic matrix composite materials), heat resistant alloys (e.g., metallic superalloys), and the like. For example, each of the tile 120 and the heatshield 140 may be made from a nickel-based superalloy.

The combustor assembly 100 further includes a compartment 160 thermally shielded from the combustion space 165. Either the heatshield 140 and the tile 120 together form the compartment 160 or the tile 120 alone forms the compartment 160. In other words, in some embodiments, the compartment 160 may be formed by the heatshield 140 and the tile 120. In some other embodiments, the compartment 160 may be formed by the tile 120 alone. It may be noted that the compartment 160 may further be formed or delimited by the combustor shell 110.

The combustor assembly 100 further includes a fastener 150 connecting the tile flange portion 125 of the tile 120 to the meter panel 116 of the combustor shell 110. The fastener 150 extends along the shell axis 111. In other words, a principal axis of the fastener may be substantially aligned with the shell axis 111 such that a length of the fastener may be substantially aligned with the shell axis 111. The fastener 150 is at least partially disposed within the compartment 160. Furthermore, the fastener 150 is spaced apart from the combustion space 165.

The compartment 160 of the combustor assembly 100 may thermally shield and protect the fastener 150 from the high combustion temperatures of the combustion space 165. Specifically, the heatshield 140 and/or the tile 120 forming the compartment 160 may thermally shield and protect the fastener 150 from the high combustion temperatures. Consequently, the fastener 150 may have a prolonged operational lifespan and may perform reliably over its operational lifespan. As a result, the fastener 150 may reliably connect the tile flange portion 125 of the tile 120 to the meter panel 116 of the combustor shell 110.

The combustor assembly 100 may therefore have a reliable connection between the tile 120 and the combustor shell 110, and as a result may have an improved mechanical integrity. Furthermore, the combustor assembly 100 may have reduced manufacturing lead times, reduced maintenance costs, and may be easier to maintain as compared to a conventionally fabricated combustor liner.

It may be noted that the tile 120 may include a plurality of tiles 120 disposed circumferentially around the shell axis 111 and adjacent to the shell wall 112. Each of the plurality of tiles 120 may include the corresponding tile flange portion 125. Further, the fastener 150 may include a plurality of fasteners 150 connecting the tile flange portions 125 of the corresponding plurality of tiles 120 to the meter panel 116. The plurality of tiles 120 and the plurality of fasteners 150 may have a circumferential arrangement with respect to the shell axis 111.

As shown in FIG. 2, the tile 120 may further include an upstream part 130. The upstream part 130 may include the tile flange portion 125. The upstream part 130 may further include the upstream end 121 of the tile 120. The tile 120 may further include a downstream part 132 spaced apart from the upstream part 130. The downstream part 132 may include the downstream end 122 of the tile 120. The downstream part 132 may at least partially engage the shell wall 112 of the combustor shell 110. The tile 120 may further include a main part 134 connecting the upstream part 130 to the downstream part 132. The main part 134 may be radially spaced apart from the shell wall 112 with respect to the shell axis 111.

The combustor assembly 100 may further include a bracket 170 connected to the downstream end 114 of the shell wall 112 of the combustor shell 110. The bracket 170 may be connected to the downstream end 122 of the combustor shell 110 by a downstream fastener 156. The downstream fastener 156 may include, for example, a nut and a bolt, a rivet, a stud bolt, and the like. The tiles can be changed as necessary by removing the bracket 170.

The bracket 170 may include a hook 171 extending towards the tile 120 along the shell axis 111. The hook 171 may at least partially engage and support the downstream part 132 of the tile 120, such that the downstream part 132 is at least partially disposed between the shell wall 112 and the hook 171. In other words, the bracket 170 may define a bird-mouth that receives the downstream part 132 of the tile 120. Advantageously, axial clearance between the bracket 170 and tile downstream end 122 may allow for differing relative thermal expansion along the shell axis 111 of the shell wall 112 and/or the tile 120 while retaining the downstream part 132 of the tile 120 in a floating relationship relative to the shell wall 112.

Figure 3:
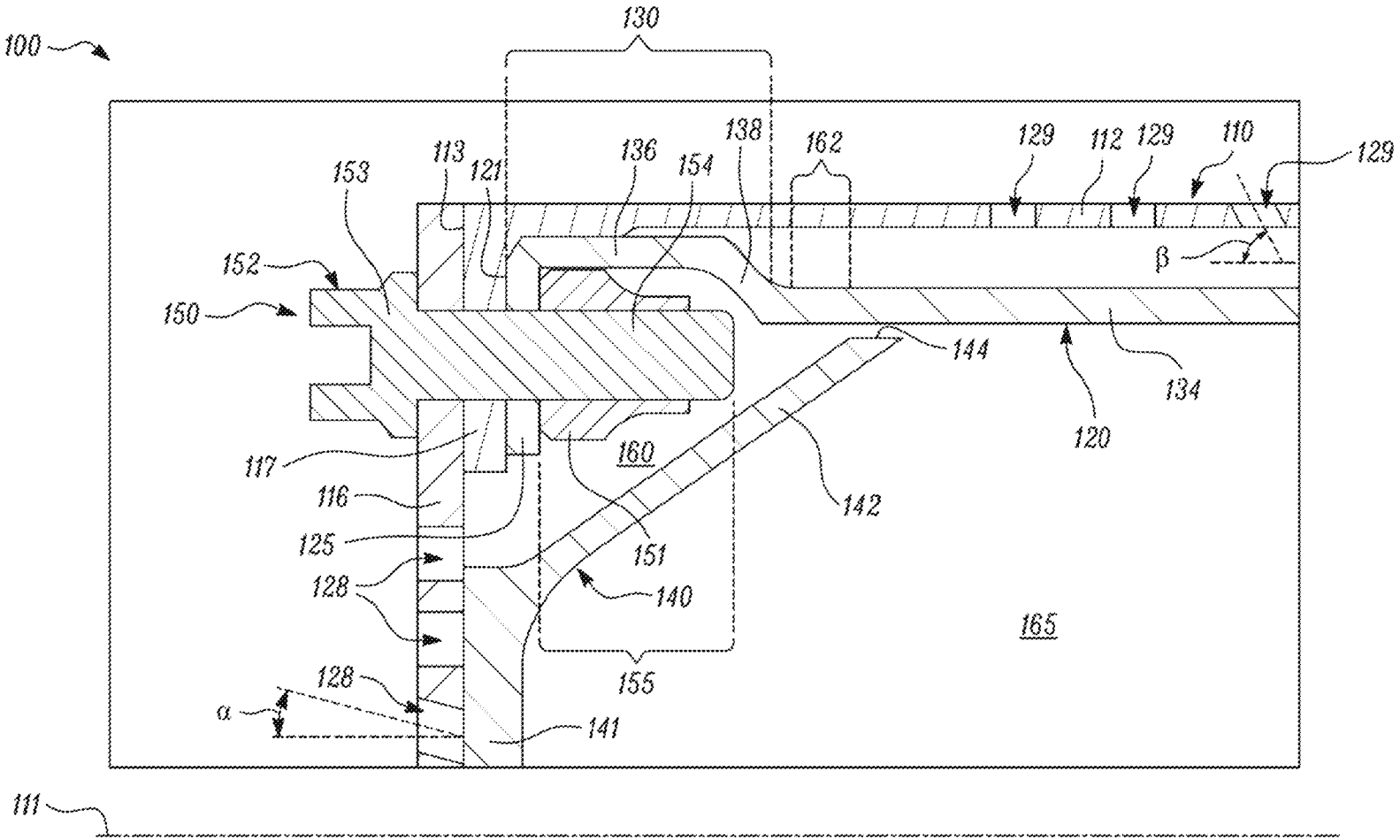
FIG. 3 is a schematic zoomed-in cross-sectional view of a portion of the combustor assembly of FIG. 2.

FIG. 3 shows a schematic zoomed-in cross-sectional view of a portion of the combustor assembly 100 in accordance with an embodiment of the present disclosure.

As discussed above, the upstream part 130 of the tile 120 includes the tile flange portion 125. The upstream part 130 may further include an intermediate portion 136 connected to the tile flange portion 125. The intermediate portion 136 may extend axially along the shell axis 111. The upstream part 130 may further include an oblique portion 138 extending from the intermediate portion 136 and obliquely inclined to the shell axis 111. The oblique portion 138 may be connected to the main part 134.

In the illustrated embodiment of FIG. 3, the intermediate portion 136 is disposed radially outwards of the main part 134 with respect to the shell axis 111. Furthermore, the intermediate portion 136 at least partially engages the shell wall 112. The oblique portion 138 of the tile 120 is therefore inclined inwardly from the intermediate portion 136 with respect to the shell axis 111. Moreover, the tile flange portion 125 extends radially inwards from the intermediate portion 136 with respect to the shell axis 111, such that the heatshield 140 and the tile 120 together form the compartment 160. In such embodiments, the fastener 150 may be at least partially disposed between the intermediate portion 136 of the tile 120 and the heatshield 140.

Specifically, as shown in FIG. 3, the heatshield 140 may include a main body 141 that is connected to the meter panel 116. The heatshield 140 may further include an arm 142 that extends obliquely with respect to the shell axis 111 from the main body 141 towards the tile 120. The arm 142 may have a free end 144 opposite to the main body 141 and disposed adjacent to the tile 120.

In some embodiments, the main part 134 of the tile 120 may include a compartment portion 162 that is axially disposed between the intermediate portion 136 of the tile 120 and the free end 144 of the arm 142 with respect to the shell axis 111. The arm 142 of the heatshield 140, the upstream part 130 of the tile 120, and the compartment portion 162 of the main part 134 may together form the compartment 160. In some embodiments, the meter panel 116 may further delimit the compartment 160.

As shown in FIG. 3, in some embodiments, the shell wall 112 may further include a shell flange portion 117 that extends radially inwards with respect to the shell axis 111. The shell flange portion 117 may be disposed at the upstream end 113 of the shell wall 112. The shell flange portion 117 may be at least partially disposed between the meter panel 116 and the tile flange portion 125.

The fastener 150 may further connect the shell flange portion 117 to the meter panel 116, such that the fastener 150 connects the meter panel 116, the tile 120, and the shell wall 112 to each other. Use of the fastener 150 to connect the meter panel 116, the tile 120, and the shell wall 112 to each other may reduce a time taken to assemble the combustor assembly 100 as compared to a conventionally fabricated combustor liner, which may include additional steps (such as welding) for assembly.

In some embodiments, the fastener 150 may include a nut 151 and a bolt 152. The nut 151 may be disposed adjacent to the tile flange portion 125 opposite to the shell flange portion 117. The bolt 152 may be threadably connected to the nut 151. In some embodiments, the nut 151 may be a shank nut.

The bolt 152 may include a head 153 disposed adjacent to the meter panel 116 opposite to the compartment 160. The bolt 152 may further include a shaft 154 connected to the head 153 and extending towards the compartment 160. The shaft 154 may extend at least partially through each of the tile flange portion 125, the shell flange portion 117, and the meter panel 116.

The shaft 154 may include an exposed portion 155 that is threadably connected to the nut 151 and extends axially from the tile flange portion 125 along the shell axis 111. The nut 151 and the exposed portion 155 of the shaft 154 may be fully disposed within the compartment 160.

In some embodiments, the nut 151 may be connected to the tile flange portion 125. Advantageously, this may allow the bolt 152 to be threadably fastened to the nut 151 without needing access to the nut 151 and the compartment 160.

As shown in FIG. 3, the meter panel 116 may further include a plurality of panel apertures 128 that are in fluid communication with the heatshield 140. The plurality of panel apertures 128 may extend through a thickness of the meter panel 116. The compressed air exhausted from the high pressure compressor 15 (shown in FIG. 1) may be directed towards the heatshield 140 through the plurality of panel apertures 128 to reduce a temperature of the heatshield 140.

In some embodiments, one or more panel apertures 128 from the plurality of panel apertures 128 may be obliquely inclined with respect to the shell axis 111. Specifically, the one or more panel apertures 128 may be inclined to the shell axis 111 by a panel aperture angle $\alpha$, which, for example, may be from 5° to 70°. In some embodiments, one or more panel apertures 128 from the plurality of panel apertures 128 may be generally parallel to the shell axis 111.

Further, in some embodiments, the shell wall 112 of the combustor shell 110 may further include a plurality of wall apertures 129 that are in fluid communication with the tile 120. The plurality of wall apertures 129 may extend through a thickness of the shell wall 112. The compressed air exhausted from the high pressure compressor 15 (shown in FIG. 1) may be further directed towards the shell wall 112 through the plurality of wall apertures 129 to reduce a temperature of the tile 120.

In some embodiments, one or more wall apertures 129 from the plurality of wall apertures 129 may be obliquely inclined with respect to the shell axis 111. Specifically, the one or more wall apertures 129 may be inclined to the shell axis 111 by a wall aperture angle $\beta$, which, for example, may be from 5° to 70°. In some embodiments, one or more wall apertures 129 from the plurality of wall apertures 129 may be generally perpendicular to the shell axis 111.

Figure 4:
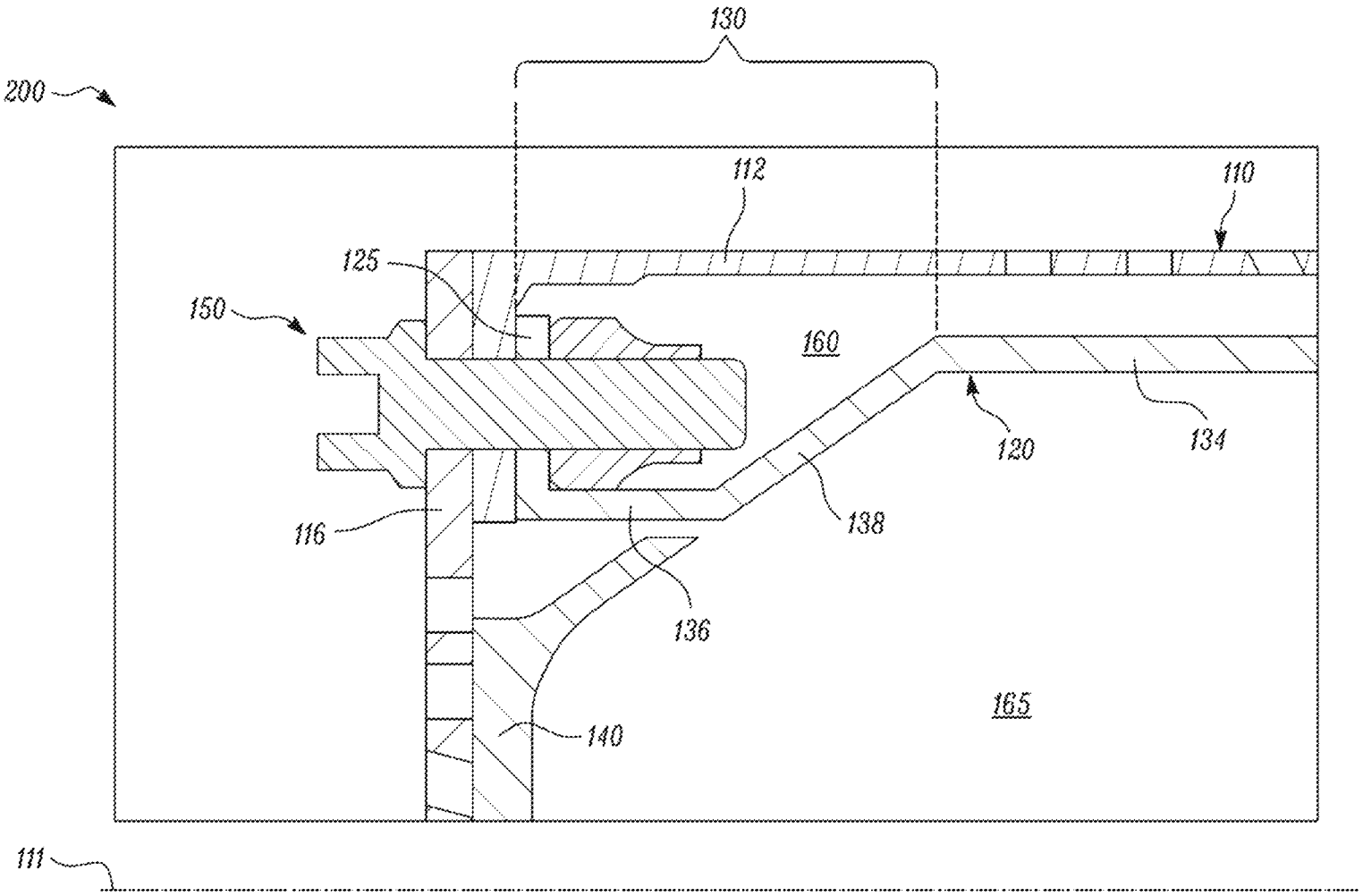
FIG. 4 is a schematic cross-sectional view of a portion of a combustor assembly.

FIG. 4 shows a schematic cross-sectional view of a portion of a combustor assembly 200 in accordance with another embodiment of the present disclosure. The combustor assembly 200 is similar to the combustor assembly 100 of FIG. 3, with like components designated by like reference characters. However, the combustor assembly 200 includes a different configuration of the tile 120 and the compartment 160 than that of the combustor assembly 100.

Specifically, in the illustrated embodiment of FIG. 4, the intermediate portion 136 of the tile 120 is disposed radially inwards of the main part 134 with respect to the shell axis 111. Furthermore, the intermediate portion 136 of the tile 120 is radially spaced apart from the shell wall 112 of the combustor shell 110. Therefore, in the illustrated embodiment of FIG. 4, the oblique portion 138 of the tile 120 is inclined outwardly from the intermediate portion 136 with respect to the shell axis 111. Moreover, the tile flange portion 125 extends radially outwards from the intermediate portion 136 with respect to the shell axis 111, such that the tile 120 forms the compartment 160. In other words, in the illustrated embodiment of FIG. 4, the tile 120 alone forms the compartment 160. In such embodiments, the shell wall 112 may further delimit the compartment 160. Further, the fastener 150 may be at least partially disposed between the intermediate portion 136 of the tile 120 and the shell wall 112 of the combustor shell 110.

Figure 5:
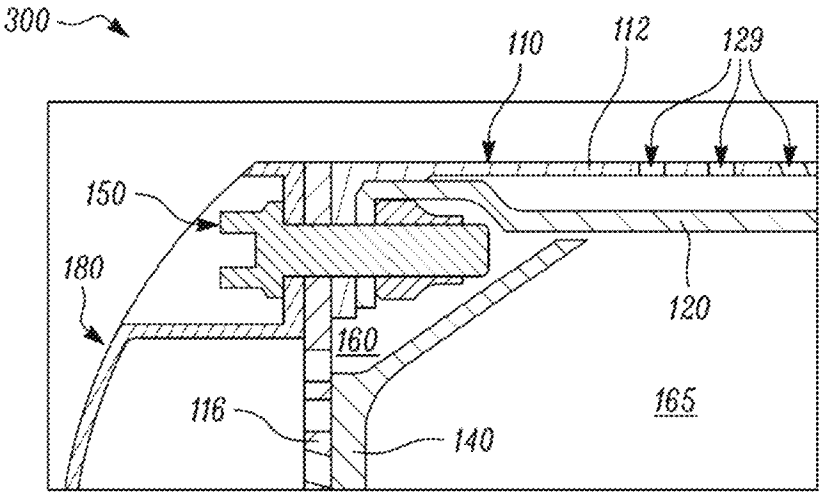
FIG. 5 is a schematic cross-sectional view of a portion of a combustor assembly.

FIG. 5 illustrates a schematic cross-sectional view of a portion of a combustor assembly 300 in accordance with another embodiment of the present disclosure. Further, FIG. 6 illustrates a schematic cross-sectional view of a portion of a combustor assembly 400 in accordance with another embodiment of the present disclosure.

The combustor assembly 300 is similar to the combustor assembly 100 of FIG. 3, with like components designated by like reference characters. Further, the combustor assembly 400 is similar to the combustor assembly 200 of FIG. 4, with like components designated by like reference characters.

Figure 6:
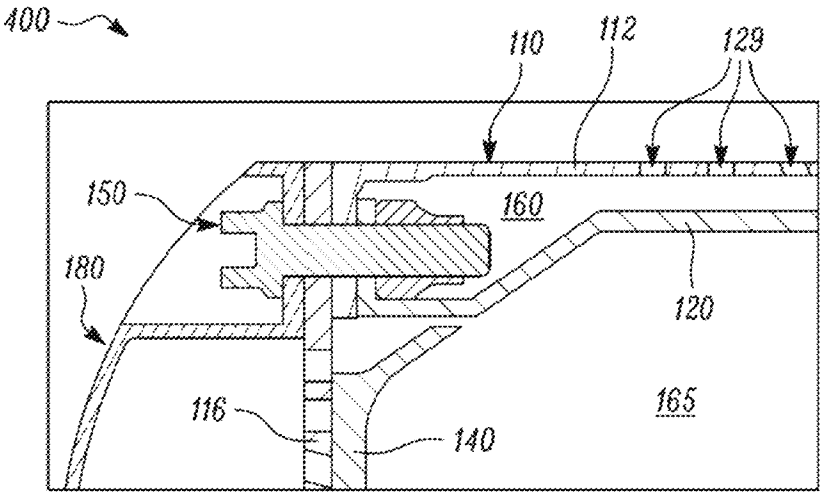
FIG. 6 is a schematic cross-sectional view of a portion of a combustor assembly.

Referring to FIGS. 5 and 6, each of the combustor assemblies 300, 400 includes an aerodynamic dome 180 that is disposed upstream of the meter panel 116. The fastener 150 further connects the aerodynamic dome 180 to the meter panel 116. In some embodiments, the fastener 150 may connect the aerodynamic dome 180, the meter panel 116, the shell wall 112, and the tile 120 to each other.

The aerodynamic dome 180 may assist in directing a portion of the compressed air from the high pressure compressor 15 (shown in FIG. 1) to the plurality of wall apertures 129 of the shell wall 112. The aerodynamic dome 180 may therefore improve cooling of the tile 120.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

I claim:

1. A combustor assembly for a gas turbine engine, the combustor assembly comprising:

a combustor shell extending along a shell axis, the combustor shell comprising:

a shell wall extending circumferentially around the shell axis, the shell wall comprising an upstream end and a downstream end opposite to the upstream end; and a meter panel connected to the upstream end of the shell wall and extending radially with respect to the shell axis, wherein the meter panel and the shell wall together define a combustion space therebetween;

a tile disposed within and adjacent to the combustor shell, the tile comprising a tile flange portion disposed at an upstream end of the tile and extending radially with respect to the shell axis, wherein the tile flange portion is disposed adjacent to the meter panel;

wherein the tile further comprises:

an upstream part comprising the tile flange portion; wherein the upstream part further comprises:

an intermediate portion connected to the tile flange portion and extending axially along the shell axis; and an oblique portion extending from the intermediate portion and obliquely inclined to the shell axis, wherein the oblique portion is connected to the main part:

a downstream part spaced apart from the upstream part and at least partially engaging the shell wall of the combustor shell; and a main part connecting the upstream part to the downstream part, wherein the main part is radially spaced apart from the shell wall with respect to the shell axis;

a heatshield connected to the meter panel radially inwards of the combustor shell and extending at least radially towards the tile;

a fastener connecting the tile flange portion of the tile to the meter panel of the combustor shell, wherein the fastener extends along the shell axis; and a compartment thermally shielded from the combustion space;

wherein the fastener is spaced apart from the combustion space;

wherein the fastener is at least partially disposed within the compartment;

wherein the intermediate portion is disposed radially outwards of the main part with respect to the shell axis and at least partially engages the shell wall, and wherein the tile flange portion extends radially inwards from the intermediate portion with respect to the shell axis, such that the heatshield and the tile together form the compartment.

2. The combustor assembly of claim 1, wherein the heatshield comprises:

a main body that is connected to the meter panel; and an arm that extends obliquely with respect to the shell axis from the main body towards the tile, wherein the arm has a free end opposite to the main body and disposed adjacent to the tile;

wherein the main part of the tile comprises a compartment portion that is axially disposed between the intermediate portion of the tile and the free end of the arm with respect to the shell axis, and wherein the arm of the heatshield, the upstream part of the tile, and the compartment portion of the main part together form the compartment.

3. The combustor assembly of claim 1, wherein the fastener is at least partially disposed between the intermediate portion of the tile and the heatshield.

4. The combustor assembly of claim 1, wherein the meter panel further delimits the compartment.

5. The combustor assembly of claim 1, further comprising a bracket that is connected to the downstream end of the shell wall of the combustor shell, the bracket comprising a hook extending towards the tile along the shell axis, wherein the hook at least partially engages and supports the downstream part of the tile, such that the downstream part is at least partially disposed between the shell wall and the hook.

6. The combustor assembly of claim 1, wherein the shell wall further comprises a shell flange portion that extends radially inwards with respect to the shell axis and is at least partially disposed between the meter panel and the tile flange portion, and wherein the fastener further connects the shell flange portion to the meter panel, such that the fastener connects the meter panel, the tile, and the shell wall to each other.

7. The combustor assembly of claim 6, wherein the fastener comprises:

a nut disposed adjacent to the tile flange portion opposite to the shell flange portion; and a bolt that is threadably connected to the nut, the bolt comprising:

a head disposed adjacent to the meter panel opposite to the compartment; and a shaft connected to the head and extending towards the compartment, the shaft extending at least partially through each of the tile flange portion, the shell flange portion, and the meter panel, the shaft comprising an exposed portion that is threadably connected to the nut and extends axially from the tile flange portion along the shell axis;

wherein the nut and the exposed portion of the shaft are fully disposed within the compartment.

8. The combustor assembly of claim 7, wherein the nut is connected to the tile flange portion.

9. The combustor assembly of claim 1, further comprising an aerodynamic dome that is disposed upstream of the meter panel, wherein the fastener further connects the aerodynamic dome to the meter panel.

10. The combustor assembly of claim 1, wherein the meter panel comprises a plurality of panel apertures that are in fluid communication with the heatshield.

11. The combustor assembly of claim 1, wherein the shell wall of the combustor shell comprises a plurality of wall apertures that are in fluid communication with the tile.

12. A combustor for a gas turbine engine, the combustor including the combustor assembly of claim 1.

13. A gas turbine engine including the combustor assembly of claim 1.

* * * * *